US007481631B2

(12) United States Patent
Park et al.

(10) Patent No.: US 7,481,631 B2
(45) Date of Patent: Jan. 27, 2009

(54) VARIABLE CAPACITY ROTARY COMPRESSOR

(75) Inventors: Jae Woo Park, Suwon-si (KR); Seung Kap Lee, Suwon-si (KR); Chun Mo Sung, Hwasung-Si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 262 days.

(21) Appl. No.: 11/246,251

(22) Filed: Oct. 11, 2005

(65) Prior Publication Data

US 2006/0222543 A1 Oct. 5, 2006

(30) Foreign Application Priority Data

Mar. 29, 2005 (KR) ..... 10-2005-0026140

(51) Int. Cl.
*F01C 20/22* (2006.01)

(52) U.S. Cl. ..... 418/29; 418/60; 417/218; 417/221

(58) Field of Classification Search ..... 418/69, 418/29, 60, 63; 417/221, 218
See application file for complete search history.

(56) References Cited

U.S. PATENT DOCUMENTS 1,075,710 A * 10/1913 Goodwin ..... 411/393
2,923,438 A * 2/1960 Logan et al. ..... 222/2
3,101,004 A * 8/1963 Valentine et al. ..... 74/148
3,329,373 A * 7/1967 Wood, Jr. ..... 242/245
4,060,178 A * 11/1977 Miller ..... 222/14
5,951,261 A * 9/1999 Paczuski ..... 417/221
6,755,624 B2 * 6/2004 Bae et al. ..... 417/221
6,962,486 B2 * 11/2005 Lee et al. ..... 418/29
7,040,107 B2 * 5/2006 Lee et al. ..... 62/228.5
7,070,395 B2 * 7/2006 Lee et al. ..... 418/29
7,104,764 B2 * 9/2006 Lee et al. ..... 418/69

(Continued)

FOREIGN PATENT DOCUMENTS

CN 1534196 10/2004

(Continued)

OTHER PUBLICATIONS

Eugene A. Avallone and Theodore Baumeister III, Marks' Standard Handbook for Mechanical Engineers—10th Edition, Copyright 1996, Publisher: McGraw-Hill, pp. 8-8 to 8-30.*

(Continued)

*Primary Examiner*—Thomas E Denion
*Assistant Examiner*—Mary A Davis
(74) *Attorney, Agent, or Firm*—Stanzione & Kim, LLP

(57) ABSTRACT

A variable capacity rotary compressor to securely fix a clutch pin to a rotation shaft includes first and second compression chambers having different inner volumes, a rotation shaft penetrating the first and second compression chambers, first and second eccentric bushes disposed on an outer circumference of the rotation shaft, a slot provided between the first and second eccentric bushes, a clutch pin protruding from the rotation shaft and disposed in the slot, and a fixing pin coupled with the side of the clutch pin in the rotation shaft to securely fix the clutch pin to the rotation shaft. A groove having a predetermined width can be formed at a rear side of the clutch pin and a rear side of the fixing pin can be inserted into the groove to couple with the clutch pin in the rotation shaft.

10 Claims, 8 Drawing Sheets

U.S. PATENT DOCUMENTS

| | | | | |
|---|---|---|---|---|
| 7,134,845 | B2 * | 11/2006 | Lee et al. | 418/29 |
| 7,140,844 | B2 * | 11/2006 | Lee et al. | 418/69 |
| 7,144,224 | B2 * | 12/2006 | Kim et al. | 418/69 |
| 7,150,602 | B2 * | 12/2006 | Choi et al. | 418/29 |
| 7,150,608 | B2 * | 12/2006 | Cho et al. | 418/29 |
| 7,175,401 | B2 * | 2/2007 | Cho et al. | 418/29 |
| 7,192,259 | B2 * | 3/2007 | Lee | 418/29 |
| 7,220,108 | B2 * | 5/2007 | Cho et al. | 418/60 |
| 7,223,081 | B2 * | 5/2007 | Lee et al. | 418/69 |
| 7,226,275 | B2 * | 6/2007 | Lee et al. | 418/60 |
| 2004/0241010 | A1 * | 12/2004 | Cho et al. | 417/274 |
| 2005/0079071 | A1 * | 4/2005 | Cho et al. | 417/220 |
| 2006/0093503 | A1 * | 5/2006 | Lee et al. | 418/29 |
| 2007/0003423 | A1 * | 1/2007 | Lee | 418/29 |

FOREIGN PATENT DOCUMENTS

| | | | |
|---|---|---|---|
| KR | 2004-86559 | A | 10/2004 |

OTHER PUBLICATIONS

Chinese Office Action dated Sep. 21, 2007 issued in CN 2005101082993.

* cited by examiner

VARIABLE CAPACITY ROTARY COMPRESSOR

CROSS-REFERENCE TO RELATED APPLICATIONS

This application claims the benefit under 35 U.S.C. § 119 of Korean Patent Application No. 2005-26140, filed on Mar. 29, 2005, in the Korean Intellectual Property Office, the disclosure of which is incorporated herein in its entirety by reference.

BACKGROUND OF THE INVENTION

1. Field of the Invention

The present general inventive concept relates to a variable capacity rotary compressor, and more particularly, to a variable capacity rotary compressor in which a clutch pin to transmit rotary power of a rotation shaft to two eccentric bushes is prevented from separating from the rotation shaft.

2. Description of the Related Art

Refrigerating apparatuses, such as air conditioning apparatuses and refrigerators, for refrigerating specific spaces using a refrigerant cycle, include a compressor to compress gaseous refrigerant. Generally, the refrigerating ability of these refrigerating apparatuses is determined by the compression capacity of the compressor. When the compressing capacity of the compressor is variable, the refrigerating apparatus can be optimally controlled depending on circumstances around the refrigerating apparatus to thereby conserve energy.

The applicant has filed a variable capacity rotary compressor with the Korean Intellectual Property Office, and now published as Publication No. 10-2004-86559. This variable capacity rotary compressor includes an eccentric device to vary a volume of the compressor by selectively performing compression in one of two compression chambers with different volumes.

The eccentric device includes a rotation shaft penetrating respective compression chambers, two eccentric cams protruding from an outer circumference of the rotation shaft, two eccentric bushes rotatably disposed on outer circumferences of the respective eccentric cams, two rollers rotatably disposed on the outer circumferences of the respective eccentric bushes to compress a gaseous refrigerant, and a clutch pin to change the position of one eccentric bush to an eccentric position shifted from a center line of the rotation shaft and the position of the other eccentric bush to a position aligned with the center line of the rotation shaft, depending on the rotation direction of the rotation shaft.

In the conventional variable capacity rotary compressor having the above-described structure, when the rotation shaft rotates in the forward direction or the reverse direction, compression is performed in any one of two compression chambers with the different volumes by the eccentric device so that the compression capacity of the rotary compressor can be varied.

However, in the conventional variable capacity rotary compressor, the clutch pin protruding from the rotation shaft collides against both ends of a slot formed between two eccentric bushes when the movement direction of the clutch pin within the slot to vary the compression capacity is changed from the forward direction to the reverse direction and vice versa. Due to a shock caused by this reciprocal collision of the clutch pin, the clutch pin cannot maintain its original position and floats on the rotation shaft, causing noise or separation from the rotation shaft so that the conventional variable capacity rotary compressor may be not operated.

SUMMARY OF THE INVENTION

The present general inventive concept provides a variable capacity rotary compressor in which a clutch pin is securely fixed on a rotation shaft.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a variable capacity rotary compressor including first and second compression chambers having different inner volumes, a rotation shaft penetrating the first and second compression chambers, first and second eccentric bushes disposed on an outer circumference of the rotation shaft, a slot provided between the first and second eccentric bushes, a clutch pin protruding from the rotation shaft and disposed in the slot, and a fixing pin coupled with a side of the clutch pin in the rotation shaft to securely fix the clutch pin to the rotation shaft.

The rotation shaft may have a clutch hole formed in a radial direction and a fixing hole formed in a circumferential direction to communicate with the clutch hole, such that the clutch pin and the fixing pin can be respectively inserted into the clutch hole and the fixing hole and the fixing pin is coupled with a side of the clutch pin.

A groove having a predetermined width may be formed at a rear side of the clutch pin and a rear side of the fixing pin can be inserted into the groove to be coupled with the clutch pin in the rotation shaft.

The clutch hole and the fixing hole may be perpendicular to each other in the rotation shaft such that the fixing pin securely fixes the clutch pin.

The clutch pin may be larger than the clutch hole such that the clutch pin is tightly fitted in the clutch hole.

The fixing pin and the fixing hole may have threads such that the fixing pin can be coupled with the fixing hole by the threads.

Additional aspects of the present general inventive concept will be set forth in part in the description which follows and, in part, will be obvious from the description, or may be learned by practice of the general inventive concept.

BRIEF DESCRIPTION OF THE DRAWINGS

These and/or other aspects of the general inventive concept will become apparent and more readily appreciated from the following description of the embodiments, taken in conjunction with the accompanying drawings in which.

DETAILED DESCRIPTION OF THE PREFERRED EMBODIMENTS

Figure 1:
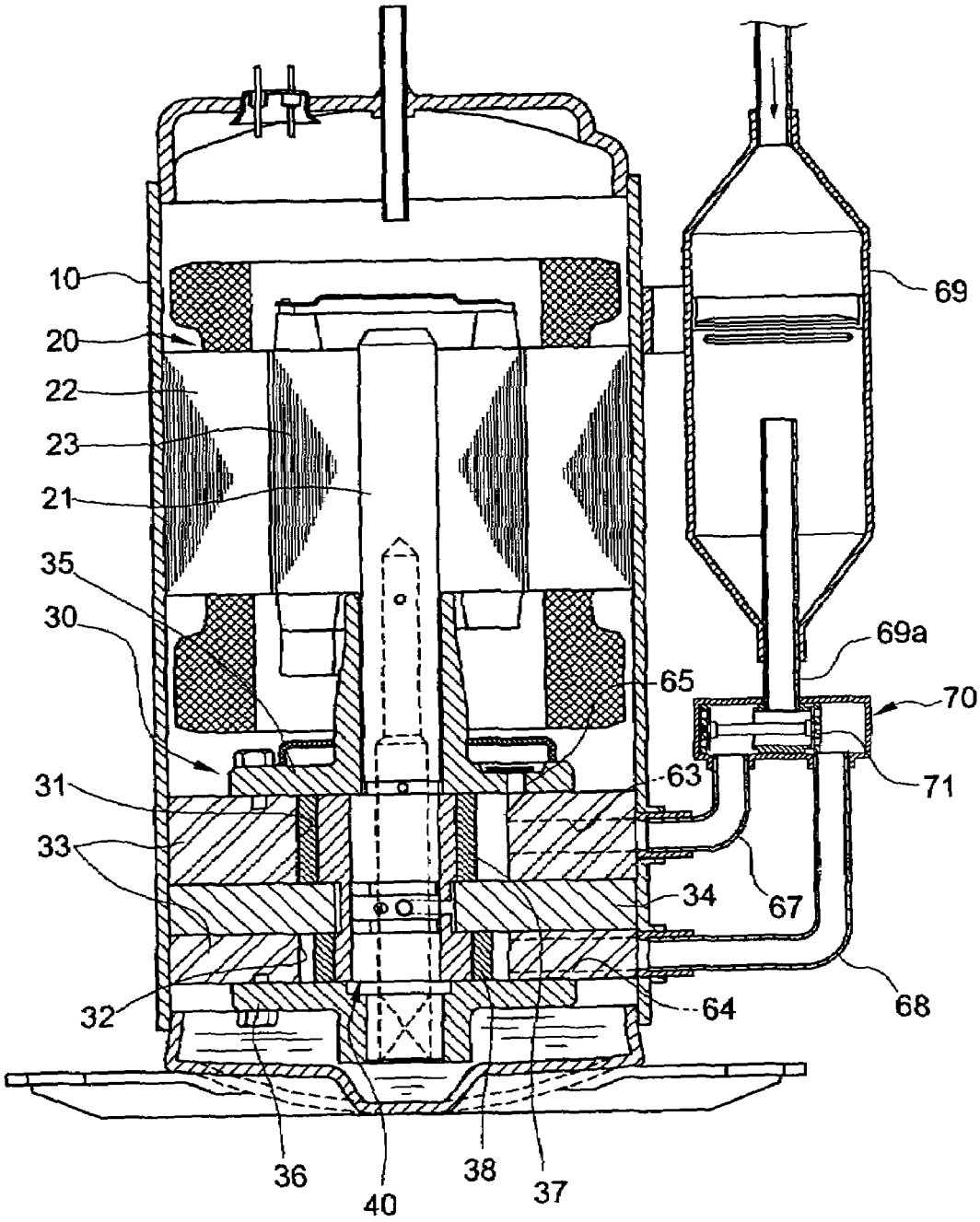
FIG. 1 is an elevation sectional view schematically illustrating an inner structure of a variable capacity compressor according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically illustrating an inner structure of a variable capacity compressor according to an embodiment of the present general inventive concept. Referring to FIG. 1, the variable capacity rotary compressor of this embodiment includes a driving part 20 installed in an airtight container 10 to generate rotational power, and a compressing part 30 to receive the rotational power generated by the driving part 20 and to compress gas.

The driving part 20 includes a cylindrical stator 22 installed in the airtight container 10, a rotor 23 rotatably installed in the stator 22, and a rotation shaft 21 extending from a central portion of the rotor 23 to rotate together with the rotor 23 in a forward direction (for example, counterclockwise) or in a reverse direction (for example, clockwise).

The compressing part 30 includes a cylindrical housing 33 having a first compression chamber 31 and a second compression chamber 32, which can be respectively provided at the upper and lower sides of the cylindrical housing 33 and have different inner volumes, a first flange 35 and a second flange 36, which can be respectively disposed on a top end and the lower end of the cylindrical housing 33 to rotatably support the rotation shaft 21, and an intermediate plate 34 disposed between the first compression chamber 31 and the second compression chamber 32 to separate the first compression chamber 31 from the second compression chamber 32.

The first compression chamber 31 can have a height greater than that of the second compression chamber 32 to have a volume greater than that of the second compression chamber 32, such that the variable capacity rotary compressor according to the embodiment of FIG. 1 has a variable capacity. Alternatively, the variable capacity rotary compressor may be designed such that the volume of the second compression chamber 32 is greater than that of the first compression chamber 31.

An eccentric device 40 is installed in the first and second compression chambers 31 and 32 to selectively perform the compression in one of the first and second compression chambers 31 and 32 depending on the rotation direction of the rotation shaft 21.

A first roller 37 and a second roller 38, which are rotatably disposed on an outer circumference of the eccentric device 40, are installed in the first and second compression chambers 31 and 32, respectively. The cylindrical housing 33 has a first suction hole 63 and a second suction hole 64 and a first discharge hole 65 and a second discharge hole 66 (See FIG. 6), which respectively communicate with the first and second compression chambers 31 and 32.

Figure 5:
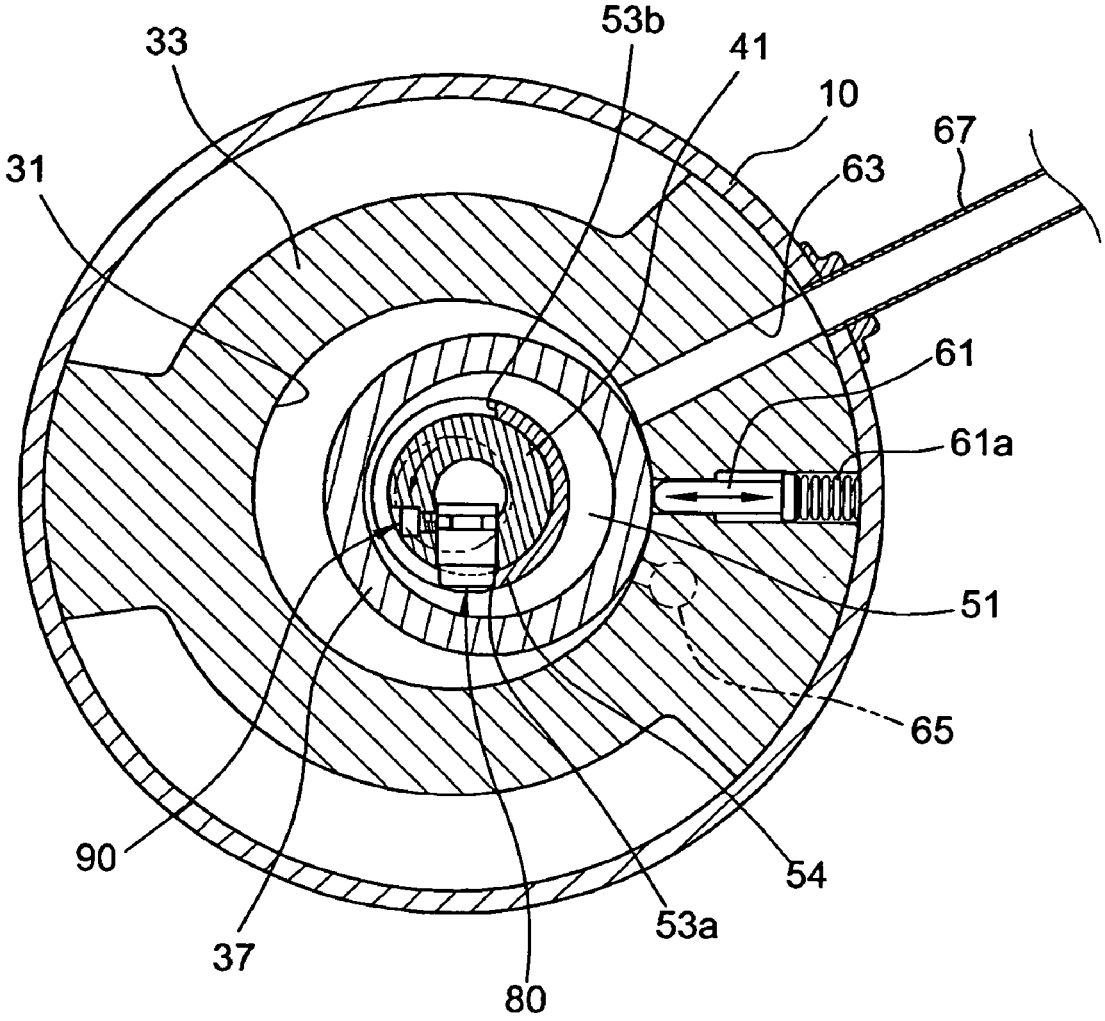
FIG. 5 is a view illustrating compression performed in an upper compression chamber by the eccentric device of FIG. 2 when the rotation shaft is rotated in a forward direction.

A first vane 61 is disposed between the first suction hole 63 and the first discharge hole 65 to closely contact the first roller 37 due to a first support spring 61*a* in a radial direction (See FIG. 5). A second vane 62 is disposed between the second suction hole 64 and the second discharge hole 66 to closely contact the second roller 38 due to a support spring 62*a* in the radial direction (See FIG. 7).

A passage switch 70 is installed at an outlet pipe 69*a* of an accumulator 69 to separate a liquid refrigerant and to introduce only a gaseous refrigerant to the compressor, to selectively open and close first and second suction pipes 67 and 68 such that the gaseous refrigerant is supplied into only one of the respective first and second suction holes 63 and 64 at a time corresponding to the one of the first and second compression chambers 31 and 32 where the compression is performed. The passage switch 70 includes a valve 71 installed therein to move right and left, and driven due to a pressure difference between the first suction pipe 67 connected to the first suction hole 63 and the second suction pipe 68 connected to the second suction hole 64.

Figure 2:
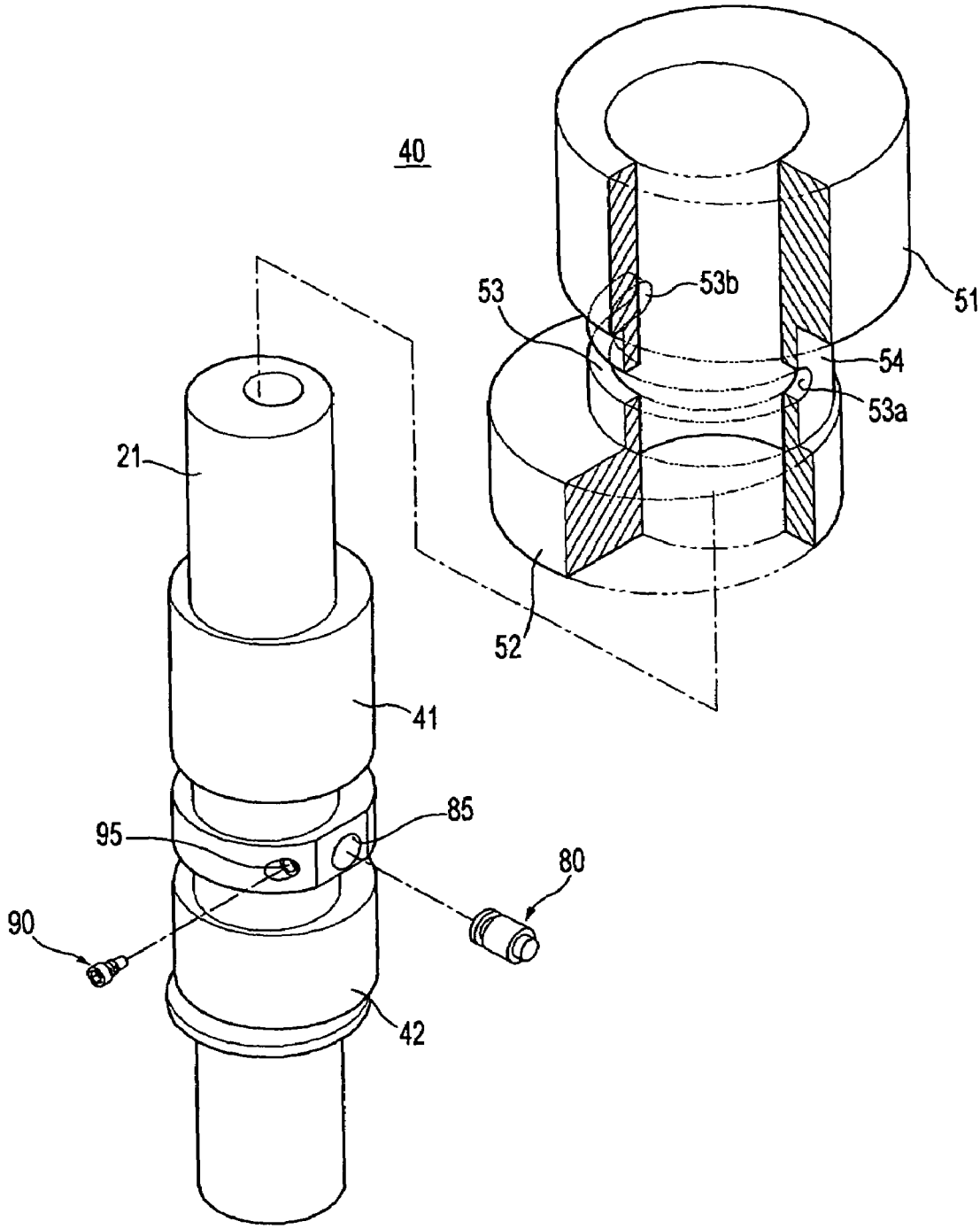
FIG. 2 is an exploded perspective view illustrating an eccentric device and a rotation shaft of the variable capacity compressor of FIG. 1.
Figure 3:
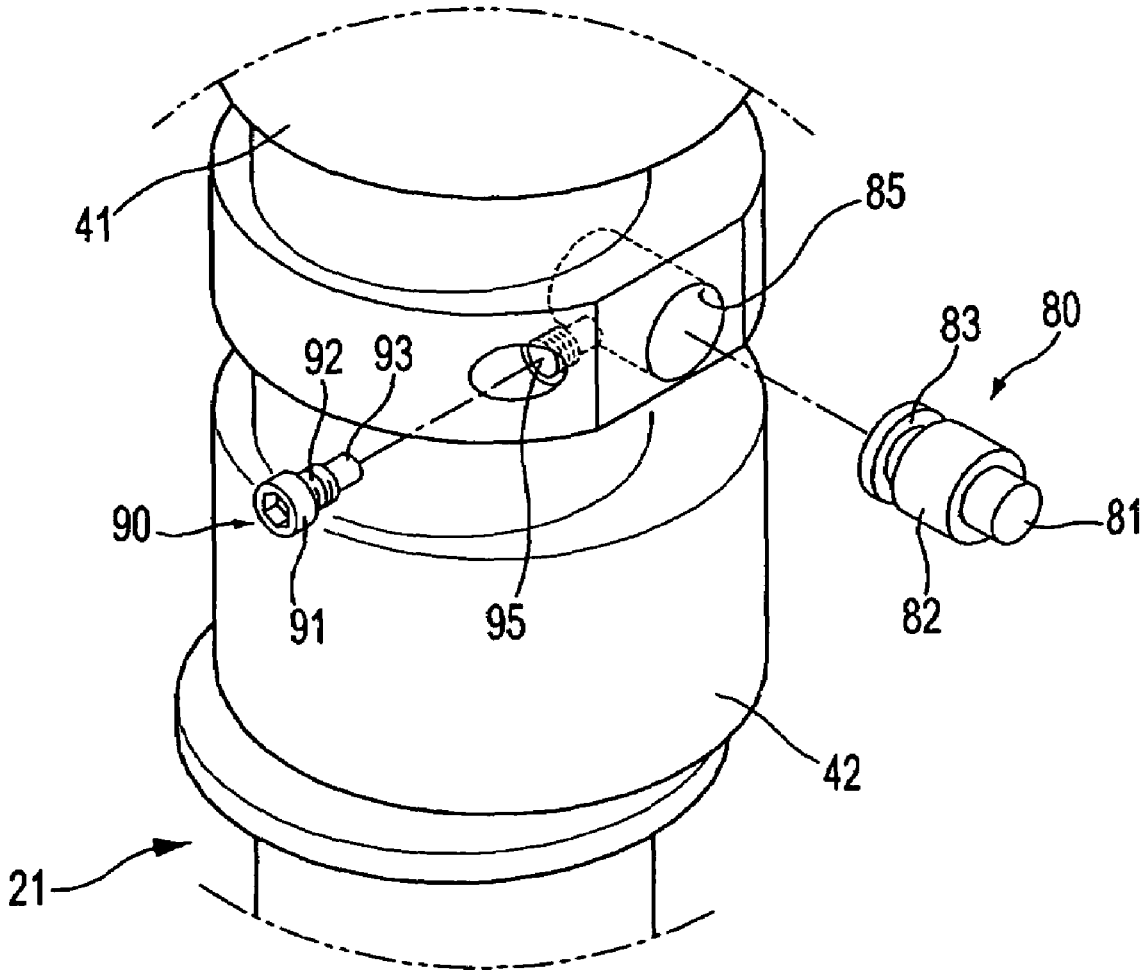
FIGS. 3 and 4 are partially enlarged views illustrating coupling of a clutch pin with the rotation shaft of FIG. 2.
Figure 4:
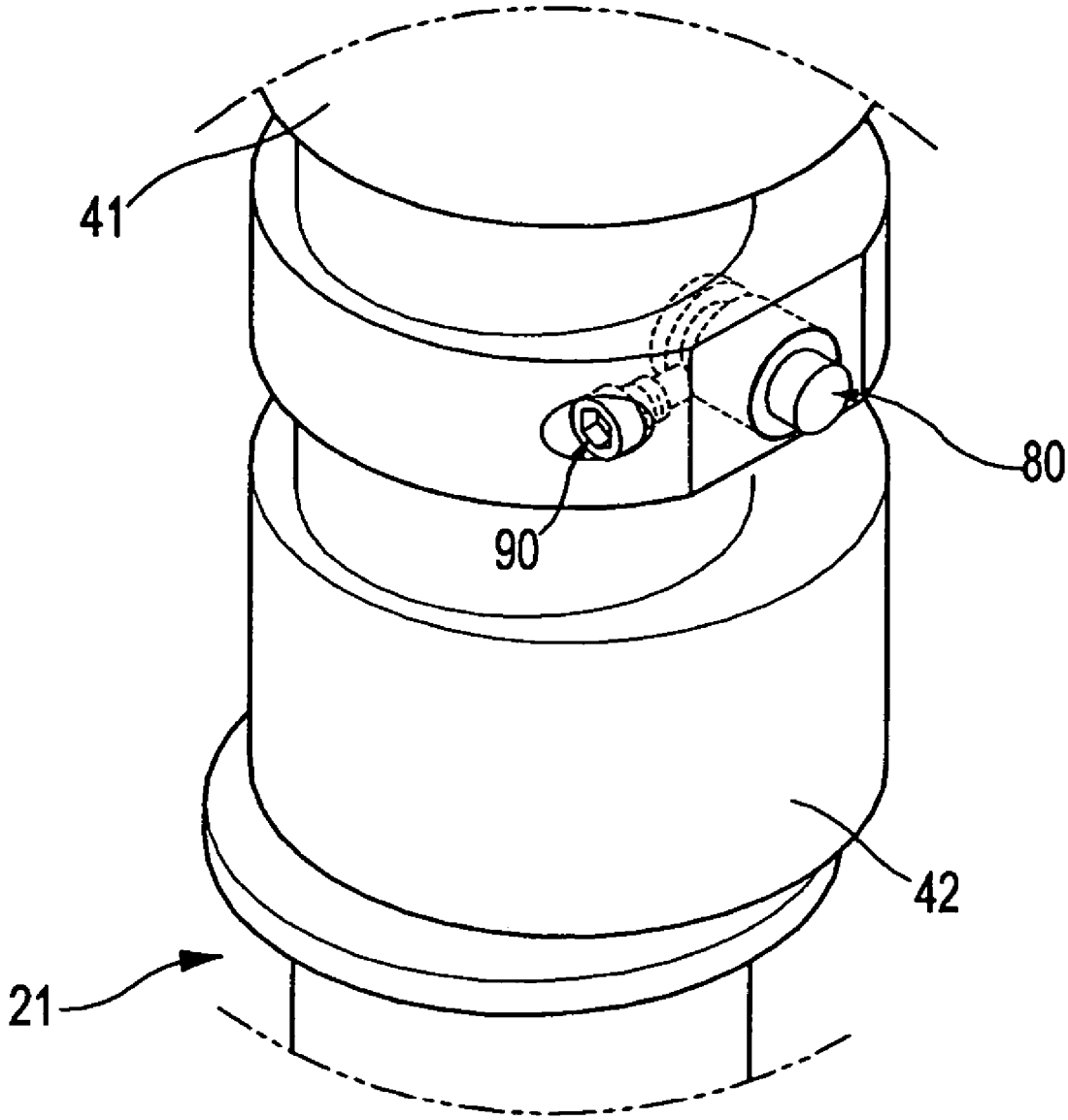

FIG. 2 is an exploded perspective view illustrating the eccentric device 40 and the rotation shaft 21, and FIGS. 3 and 4 are partially enlarged views illustrating a coupling structure in which a clutch pin is coupled with the rotation shaft 21.

Referring to FIG. 2, the eccentric device 40 includes first and second eccentric cams 41 and 42 provided respectively corresponding to the first and second compression chambers 31 and 32, first and second eccentric bushes 51 and 52 respectively disposed on outer circumferences of the first and second eccentric cams 41 and 42, a clutch pin 80 installed between the first and second eccentric cams 41 and 42, and a slot 53 of a predetermined length formed between the first and second eccentric bushes 51 and 52 such that the clutch pin 80 clutches by being locked therein when the rotation shaft 21 rotates in the forward or reverse direction.

The first and second eccentric cams 41 and 42 extend from an outer circumference of the rotation shaft 21 in the radial direction of the rotation shaft 21 and can be integrally formed with the rotation shaft 21. The first and second eccentric bushes 51 and 52 surround the outer circumferences of the first and second eccentric cams 41 and 42, respectively, and are eccentrically formed opposite to each. other. That is, the first and second eccentric bushes 51 and 52 are asymmetrically formed with respect to the rotation shaft 21 and with respect to each other.

The first and second eccentric bushes 51 and 52 can be integrally formed with each other by being connected to each other by a connector 54. The slot 53, in which the clutch pin 80 is inserted and rotates, is formed in the connector 54 in a circumferential direction. Therefore, when the clutch pin 80 rotates along the slot 53 and is locked by a first end 53*a* or a second end 53*b* of the slot 53, the first and second eccentric bushes 51 and 52 rotate together with the clutch pin 80 and their positions are changed to a coaxial position or a maximum eccentric position with respect to the rotation shaft 21. Since the first and second eccentric bushes 51 and 52 are eccentrically formed opposite to each other, when one of the first and second eccentric bushes 51 and 52 is at the coaxial position, the other one thereof is at the maximum eccentric position.

The clutch pin 80 is coupled with a fixing pin 90 in the rotation shaft 21 such that the clutch pin 80 is prevented from vibrating within the rotation shaft 21 and is securely fixed to the rotation shaft 21 even when the variable capacity rotary compressor according to this embodiment of the present general inventive concept is operated for extended periods of time.

The clutch pin 80 is inserted in a clutch hole 85 formed between the first and second eccentric cams 41 and 42 to protrude from the rotation shaft 21. The fixing pin 90, which securely fixes the clutch pin 80 to prevent the clutch pin 80 from being separated from the rotation shaft 21, is inserted into a fixing hole 95 formed in the rotation shaft 21 and spaced apart from the clutch hole 85.

Referring to FIG. 3, the clutch hole 85 runs from the outer circumference toward the center of the rotation shaft 21 in the radial direction of the rotation shaft 21. The fixing hole 95 is formed in the outer circumference of the rotation shaft 21 in the circumferential direction of the rotation shaft 21 to communicate with the clutch hole 85 in the rotation shaft 21.

Since the fixing hole 95 can be formed to be approximately perpendicular to the clutch hole 85, the fixing pin 90 can couple with a outer surface of the clutch pin 80 at a right angle such that the clutch pin 80 is effectively prevented from separating from the clutch hole 85 due to a shock generated when the clutch pin 80 repeatedly collides against the first and second ends 53*a* and 53*b* of the slot.

The clutch pin 80 can include a head 81 locked in the slot 53, a body 82 extending from the head 81 and insertable into the clutch hole 85 of the rotation shaft 21, and a groove 83 with a predetermined width formed at a rear side of the body 82.

Since the head 81 can have a smaller diameter than that of the body 82, and the body 82 can have a diameter substantially equal to that of the clutch hole 85, when the body 82 of the clutch pin 80 is tightly fitted into the clutch hole 85, the head 81 protrudes from the rotation shaft 21 and acts as a clutch within the slot 53. The body 82 of the clutch pin 80 can have a diameter size such that the clutch pin 80 is press fitted into the clutch hole 82.

The body 82 of the clutch pin 80 can have substantially the same diameter as that of the clutch hole 85, and the body 82 and the clutch hole 85 can have threads formed therein such that the clutch pin 80 is coupled with the clutch hole 85 in a thread-fastening manner.

The fixing pin 90 can include a head 91 formed with a wrench groove, a body 92 extending from the head 91 and insertable into the fixing hole 95, and a coupling part 93 extending from the body 92 and insertable into the groove 83 of the clutch pin 80.

The head 91 can have a diameter greater than that of the fixing hole 95, the body can have substantially the same diameter as that of the fixing hole 95, and the coupling part 93 can have a diameter less than that of the body 92 and substantially the same width as that of the groove 83 of the clutch pin 80. Moreover, the body 92 and the fixing hole 95 can be threaded to be coupled together.

Thus, when the fixing pin 90 is fixed in the fixing hole 95 after coupling the clutch pin 80 within the rotation shaft 21 by respectively disposing the first and second eccentric cams 41 and 42 in the first and second eccentric bushes 51 and 52 and by tightly fitting the clutch pin 80 into the clutch hole 85, as illustrated in FIG. 4, the body 92 of the fixing pin 90 is fixed in the fixing hole 95 by threads. Further, the coupling part 93 of the fixing pin 90 is inserted into the groove 83 of the clutch pin 80 such that the clutch pin 80 is tightly fixed to the rotation shaft 21. When the fixing pin 90 is coupled with the side of the clutch pin 80, the fixing pin 90 does not protrude from the rotation shaft 21.

Selective compression of a gaseous refrigerant in the first and second compression chambers 31 and 32 performed by the eccentric device 40, as described above, will be described with reference to FIGS. 5 to 8.

Figure 6:
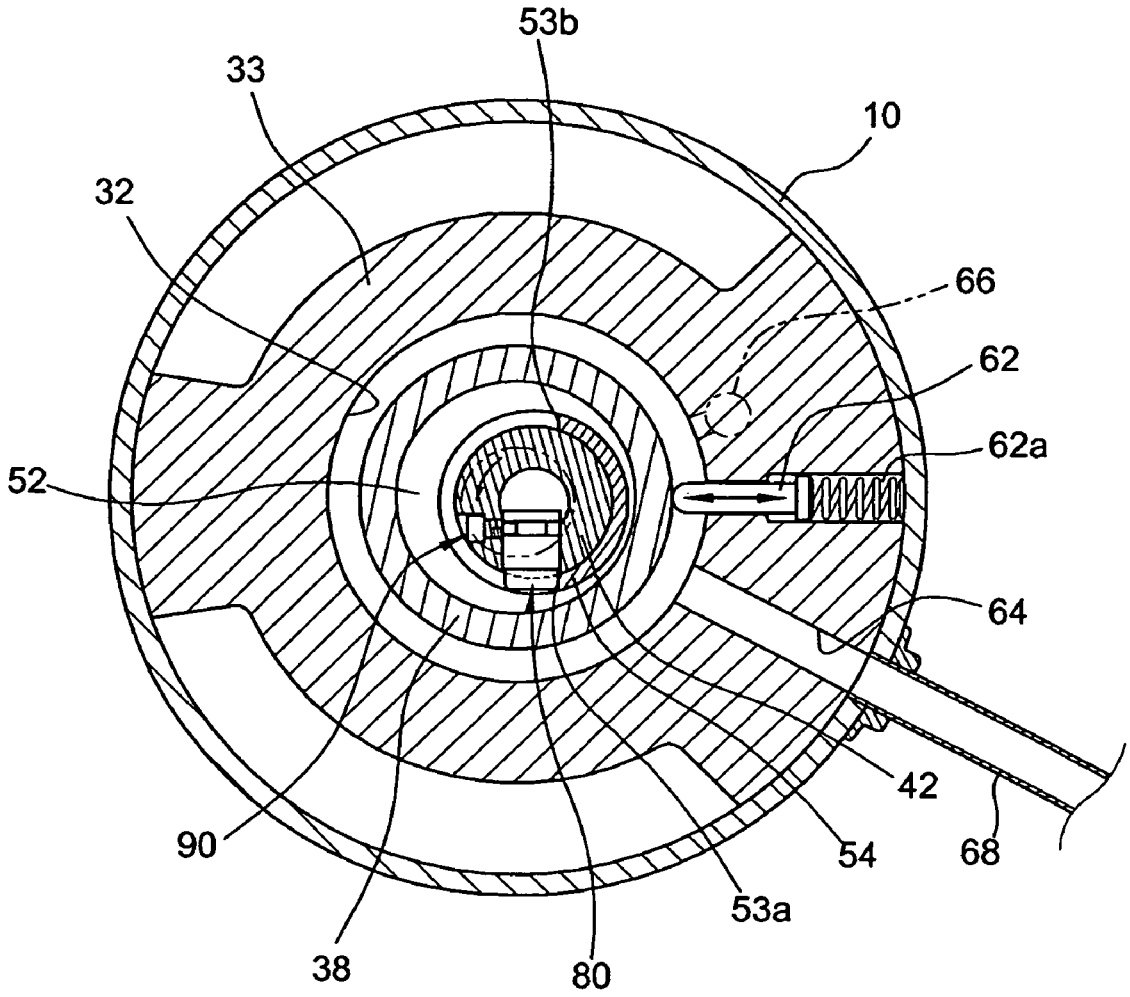
FIG. 6 is a view corresponding to FIG. 5 illustrating a lower compression chamber when compression is not performed by the eccentric device of FIG. 2 when the rotation shaft is rotated in the forward direction.

Referring to FIGS. 5 and 6, when the rotation shaft 21 rotates in the forward direction (in the counterclockwise direction as illustrated in FIGS. 5 and 6), the clutch pin 80 protruding from the rotation shaft 21 rotates along the slot 53 and is locked by the first end 53*a* of the slot 53 such that the first and second bushes 51 and 52 rotate together with the rotation shaft 21.

When the clutch pin 80 is locked in the first end 53*a* of the slot 53 and rotates, as illustrated in FIG. 5, the first eccentric bush 51 is positioned at the maximum eccentric position, where a center of the first eccentric bush 51 is misaligned with a center of the rotation shaft 21, and the first roller 37 contacts an inner circumference of the housing 33 and rotates in the first compression chamber 31. Thus, the compression is performed in the first compression chamber 31.

As illustrated in FIG. 6, the second eccentric bush 52, eccentrically positioned opposite to the position of the first eccentric bush 51, is positioned at the coaxial position, where a center of the second eccentric bush 52 is aligned with the center of the rotation shaft 21, such that the second roller 38 is spaced apart from the inner circumference of the housing by a predetermined distance in the second compression chamber 32. Thus, since no load is applied to the second roller 38, compression does not occur in the second compression chamber 32.

Therefore, when the rotation shaft 21 rotates in the forward direction, the gaseous refrigerant is introduced through the first suction hole 63 to the first compression chamber 31 having a relatively large inner volume, and is compressed by the first roller 37 and discharged out through the first discharge hole 65. The compression does not occur in the second compression chamber 32 having a relatively small inner volume, when the rotation shaft 21 rotates the forward direction. Accordingly, the rotary compressor operates with an increased compression capacity when the rotation shaft 21 rotates in the forward direction.

Figure 7:
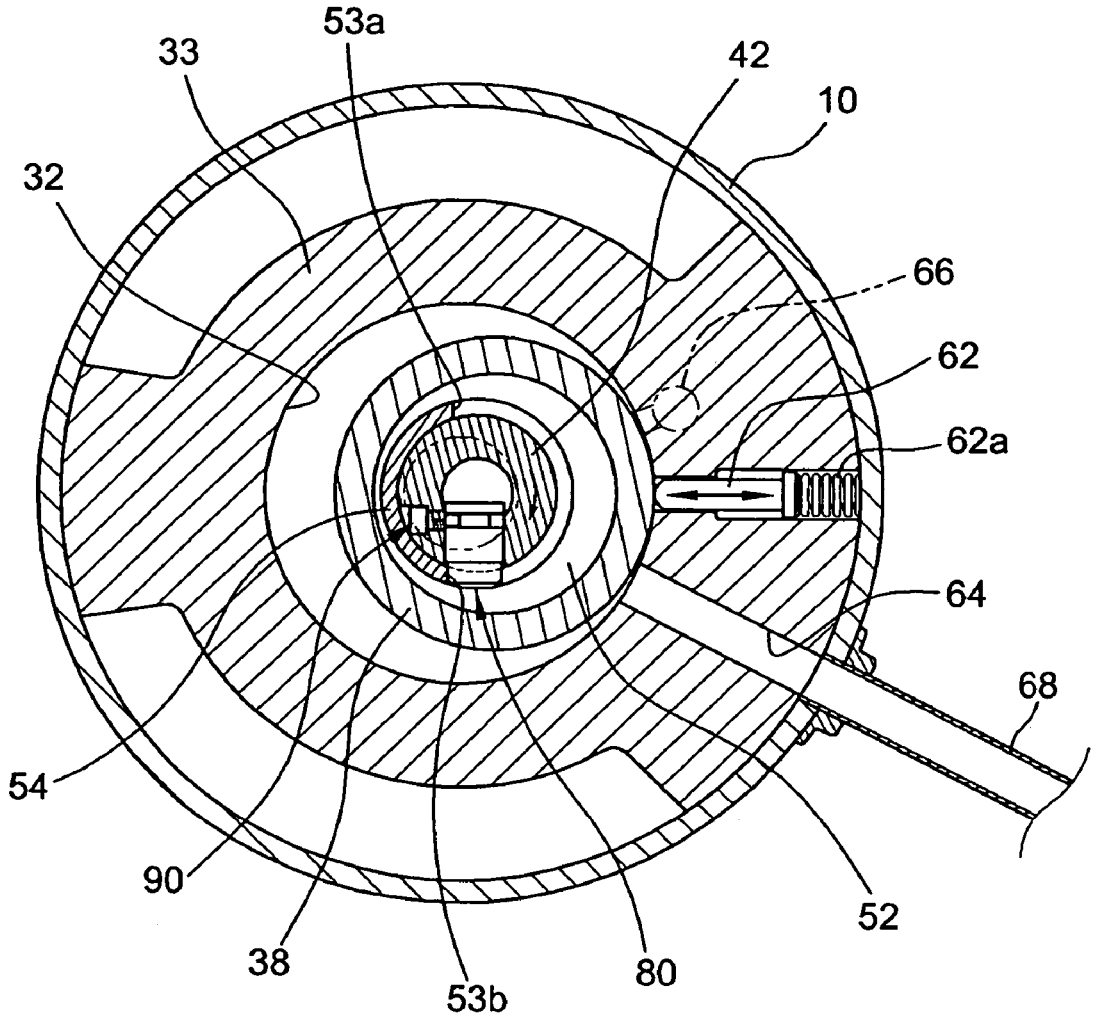
FIG. 7 is a view illustrating compression performed in the lower compression chamber by the eccentric device of FIG. 2 when the rotation shaft is rotated in a reverse direction.
Figure 8:
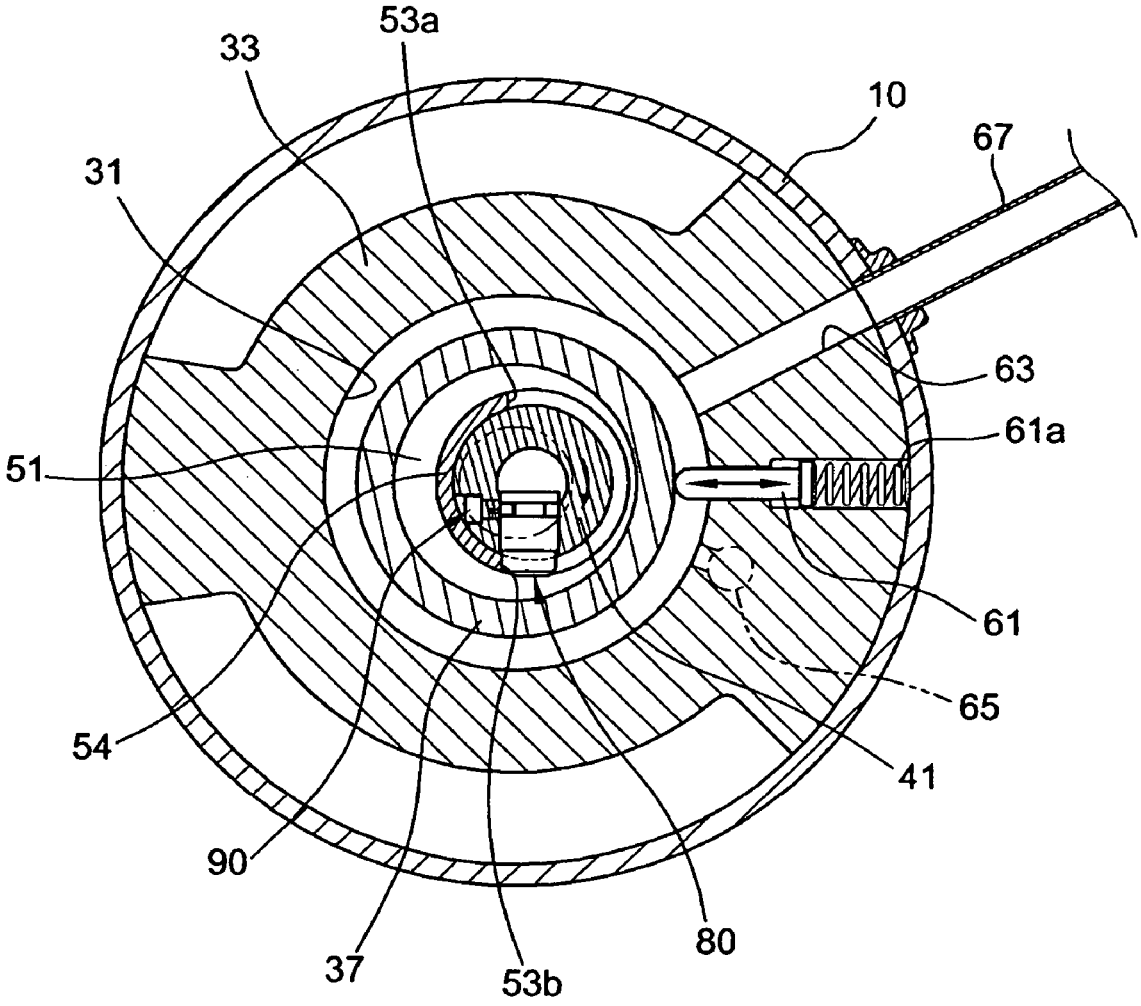
FIG. 8 is a view illustrating the upper compression chamber when compression is not performed by the eccentric device of FIG. 2 when the rotation shaft is rotated in the reverse direction.

Referring to FIGS. 7 and 8, when the rotation shaft 21 rotates in the reverse direction (in the clockwise direction as illustrated in FIGS. 7 and 8), the clutch pin 80 protruding from the rotation shaft 21 rotates along the slot 53 and is locked by the second end 53*b* of the slot 53, such that the first and second eccentric bushes 51 and 52 rotate together with the rotation shaft 21.

When the clutch pin 80 is locked by the second end 53*b* of the slot and rotates, as illustrated in FIG. 7, the second eccentric bush 52 is positioned at the maximum eccentric position, where the center of the second eccentric bush 52 is misaligned with the center of the rotation shaft 21, and the second roller 38 contacts the inner circumference of the housing 33 and rotates in the second compression chamber 32. Thus, the compression is performed in the second compression chamber 32.

As illustrated in FIG. 8, the first eccentric bush 51, eccentrically positioned opposite to the position of the second eccentric bush 52, is positioned at the coaxial position, where the center of the second eccentric bush 52 is aligned with the center of the rotation shaft 21, such that the first roller 37 is spaced apart from the inner circumference of the cylindrical housing 53 by a predetermined distance in the first compression chamber 31. Thus, no load is applied to the first roller 37 and compression does not occur in the first compression chamber 31.

Therefore, when the rotation shaft 21 rotates in the reverse direction, the gaseous refrigerant is introduced within the second compression chamber 32 having a relatively small inner volume through the second suction hole 64, and is compressed by the second roller 38 and discharged out through the second discharge hole 66. The compression does not occur in the first compression chamber 31 having a relative large inner volume when the rotation shaft 21 rotates in the reverse direction. Accordingly, the rotary compressor operates with a decreased compression capacity when the rotation shaft 21 rotates in the reverse direction.

As described above, due to the rotation of the rotation shaft 21, the first and second eccentric bushes 51 and 52, and the first and second rollers 37 and 38, minute vibrations are continuously transmitted to the clutch pin 80 coupled with the clutch hole 85, and the clutch pin 80 repeatedly collides against the first and second ends 53*a* and 53*b* of the slot 53. If this operation is continuously repeated, the clutch pin 80 may be deviated or separated from the clutch hole 85. However, according to the variable capacity rotary compressor of the present general inventive concept, since the fixing pin 90 fixes the side of the clutch pin 80 securely, the clutch pin 80 coupled with the clutch hole 85 is not separated from the clutch hole 85.

As described above, due to a structure by which a clutch pin is securely coupled with a rotation shaft by a fixing pin, since the clutch pin is securely coupled with the rotation shaft even when a vibration or shock is transmitted to the clutch pin, a variable capacity rotary compressor according to the present general inventive concept can be stably operated and is convenient to maintain and repair.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A variable capacity rotary compressor comprising:

first and second compression chambers having different inner volumes;

a rotation shaft having a clutch hole formed in a radial direction of the rotation shaft and a fixing hole formed in the rotation shaft at an angle to the clutch hole to communicate with the clutch hole and the rotation shaft penetrating the first and second compression chambers;

first and second eccentric bushes disposed on an outer circumference of the rotation shaft;

a slot provided between the first and second eccentric bushes;

a clutch pin protruding from the rotation shaft and disposed in the slot; and a fixing pin coupled with a side of the clutch pin in the rotation shaft to securely fix the clutch pin to the rotation shaft.

2. The variable capacity rotary compressor according to claim 1, wherein the clutch pin and the fixing pin are respectively inserted into the clutch hole and the fixing hole and the fixing pin couples with a side of the clutch pin.

3. The variable capacity rotary compressor according to claim 2, wherein the clutch pin comprises a groove having a predetermined width formed at a rear side thereof and a rear side of the fixing pin is inserted into the groove to couple with the clutch pin in the rotation shaft.

4. The variable capacity rotary compressor according to claim 2, wherein the clutch hole and the fixing hole are perpendicular to each other in the rotation shaft such that the fixing pin securely fixes the clutch pin.

5. The variable capacity rotary compressor according to claim 2, wherein the clutch pin is larger than the clutch hole such that the clutch pin is press fitted in the clutch hole.

6. The variable capacity rotary compressor according to claim 2, wherein the fixing pin and the fixing hole have threads such that the fixing pin is coupled with the fixing hole by the threads.

7. A variable capacity rotary compressor comprising:

first and second compression chambers having different volumes to compress gas therein;

a rotating shaft disposed through each of the plurality of compression chambers;

a clutch pin disposed at the rotating shaft to activate one of the first and second compression chambers by a rotation of the rotating shaft; and a fixing pin disposed at the rotating shaft to engage with the clutch pin to prevent the clutch pin from separating from the rotating shaft, wherein the rotating shaft comprises:

a clutch hole formed in a radial direction of the rotating shaft to accommodate the clutch pin; and a fixing hole formed in the rotating shaft at an angle to the clutch hole to accommodate the fixing pin.

8. The variable capacity rotary compressor according to claim 7, wherein the clutch hole and the fixing hole are disposed perpendicular to each other in the rotation shaft such that the fixing pin securely fixes the clutch pin.

9. The variable capacity rotary compressor according to claim 7, wherein the fixing hole communicates with the clutch hole, and the fixing pin accommodated in the fixing hole contacts the clutch pin accommodated in the clutch hole to prevent the clutch pin from separating from the clutch hole.

10. The variable capacity rotary compressor according to claim 7, wherein the fixing pin comprises a coupling portion to couple with the clutch pin to prevent the clutch pin from moving with respect to the rotating shaft, and the clutch pin comprises an accommodating portion to accommodate the coupling portion of the fixing pin.

* * * * *